US009909331B1

(12) United States Patent
Bullard

(10) Patent No.: US 9,909,331 B1
(45) Date of Patent: Mar. 6, 2018

(54) MULTI-PURPOSE POOL WATER CIRCULATION ACCELERATOR

(71) Applicant: ECO AQUANAUTICS, LLC, Cocoa, FL (US)

(72) Inventor: George Phillip Bullard, Rockledge, FL (US)

(73) Assignee: ECO AQUANAUTICS, LLC, Cocoa, FL (US)

( * ) Notice: Subject to any disclaimer, the term of this patent is extended or adjusted under 35 U.S.C. 154(b) by 123 days.

(21) Appl. No.: 14/807,881

(22) Filed: Jul. 23, 2015

Related U.S. Application Data

(60) Provisional application No. 61/999,358, filed on Jul. 24, 2014.

(51) Int. Cl.
*E04H 4/00* (2006.01)
*E04H 4/12* (2006.01)

(52) U.S. Cl.
CPC ..... *E04H 4/1245* (2013.01); *E04H 4/129* (2013.01)

(58) Field of Classification Search
CPC ..... E04H 4/1245; E04H 4/1272; E04H 4/129
USPC ..... 4/507, 508, 490
See application file for complete search history.

(56) References Cited

U.S. PATENT DOCUMENTS

| | | | | |
|---|---|---|---|---|
| 6,009,573 | A * | 1/2000 | Thibault | A61H 33/6073 4/496 |
| 6,393,628 | B1 * | 5/2002 | Kellogg | E04H 4/1272 4/490 |
| 2011/0030135 | A1 * | 2/2011 | Riley | E04H 4/129 4/507 |
| 2013/0067654 | A1 * | 3/2013 | Deloche | E04H 4/129 4/507 |

* cited by examiner

*Primary Examiner* — Huyen Le
(74) *Attorney, Agent, or Firm* — Dorothy S. Morse

(57) ABSTRACT

An accelerator used for increasing water circulation velocity through a swimming pool's filtration/heating system. It comprises one or more rigid elongated and open-ended tubular sections; one end formed at a 90-degree angle into a flange inserts into the pool vacuum intake or skimmer port. The other end may be any variety of shapes, with multiple vents or openings. When the flange end is attached to the vacuum intake, the accelerator sits parallel to the pool wall with its base close to the pool bottom. The base may have protrusions perpendicular to the body to act as feet on the wall. The accelerator can be adjusted to variable lengths with sections locking into place with male and female adapters. The accelerator's sections should have small drilled holes at intervals along their length for the safety of pool equipment and swimmers. The lowest portion of the accelerator body has a drainage hole.

18 Claims, 4 Drawing Sheets

Fig. 2
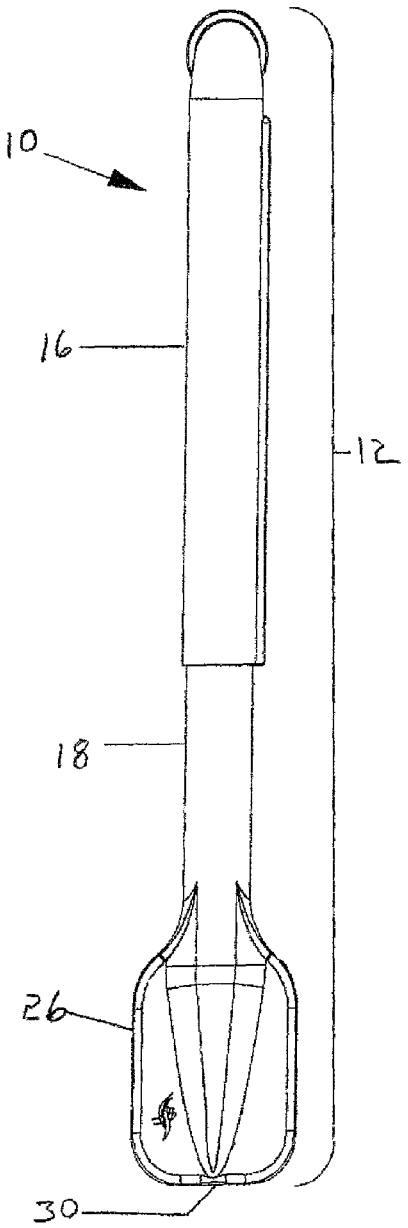
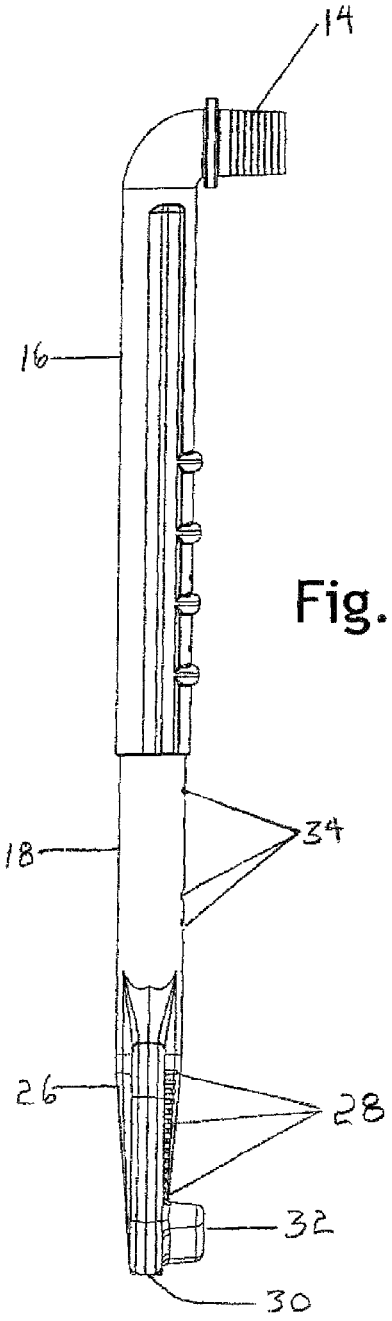
Fig. 3

Fig. 4
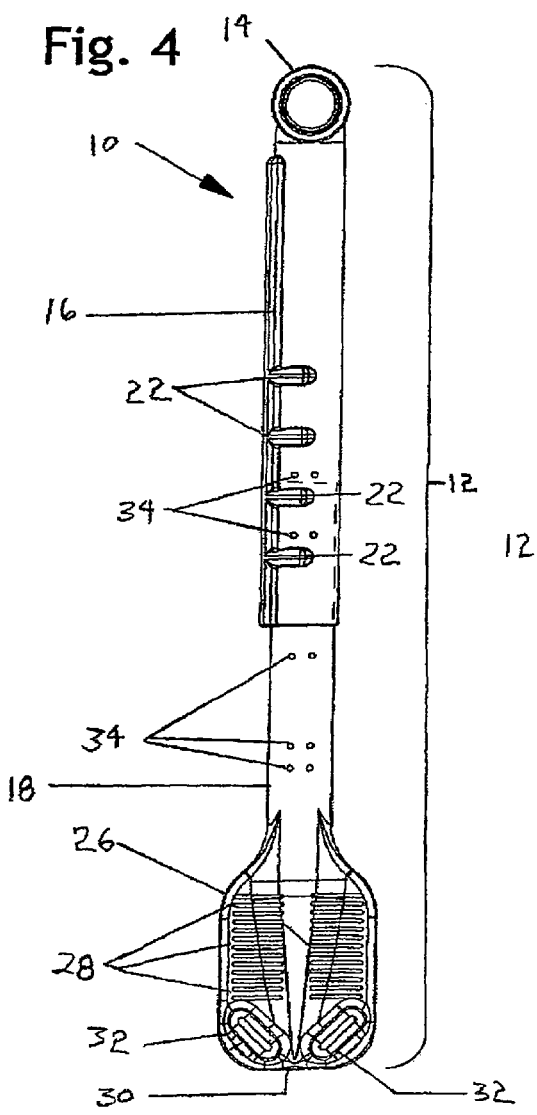
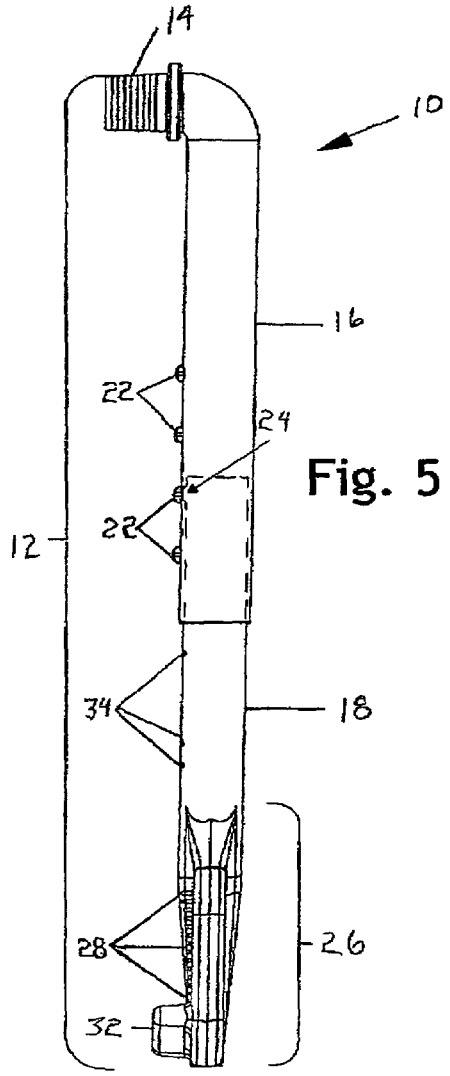
Fig. 5

MULTI-PURPOSE POOL WATER CIRCULATION ACCELERATOR

CROSS-REFERENCES TO RELATED APPLICATIONS

This application claims domestic priority benefit based upon a previously filed U.S. provisional patent application (Ser. No. 61/999,358) filed by the same inventor Jul. 24, 2014, which has the title of Eco Pool Otter.

BACKGROUND OF THE INVENTION

Field of Invention

The invention disclosed herein is a swimming pool accessory that when used in conjunction with a swimming pool pump and pool heating system has a primary function of circulating a swimming pool's water at a faster, more efficient rate than previously realized, thereby providing a benefit to swimming pool owners and users. The pool water circulation accelerator has a tubular body that attaches to the vacuum intake port or skimmer port of a swimming pool system and extends vertically downward toward the bottom of a pool so as to intake water from the lower depth of the pool, through the pool filtration system after which it goes back into the pool through the pool return jets.

Description of Related Art

Use of a swimming pool water circulation accelerator with a tubular body that attaches to the vacuum intake port or skimmer port is not known in the prior art. Known swimming pool water circulation accelerators generally comprise a tube, hose or nozzle that is used to accelerate circulation by enhancing the pressure, direction or location of the discharge of water through the return jets. For example some pools are designed with return jets on the bottom of the pool rather than the sides in order to increase the circulation of water at the bottom of the pool. However, these components just discharge water and fail to extract pool water from the lower depths of the pool, making them less efficient than the present invention. The present invention accelerates the intake of water from the bottom of the pool up through the intake port or skimmer and then discharges the water through the return jets. Currently, swimming pools are inefficient and costly to maintain and heat. The typical pool circulation system pumps water from the skimmer and the large drain in the deep end of the pool, delivering the water to the filter, then through the heater and out to the return jets. This lengthy and wasteful energy process continues until the thermostat reaches the desired water temperature, even though the water in the lower depths of the pool is still much cooler. By connecting this accelerator to a pool's existing vacuum intake or skimmer port, pool water heating is achieved in a fraction of the time, through better stratification, mixing and rising through a much larger body of water, allowing the warmer water the ability to permeate into much more cool water, much faster and allowing the coolest water to be drawn into the system for heating.

SUMMARY OF INVENTION

The primary objective of the present invention is directed to apparatus for accelerating the circulation of pool water when used in conjunction with a swimming pool filtration system and, if present, a pool heating system. The inventor moved to Florida in 2006, and began residing in a home with a swimming pool heated by solar panels. The inventor has physical disabilities and wanted to enjoy the therapeutic properties of a heated pool. It often took hours to heat the pool and the temperature usually rose only a few degrees. The Inventor began testing different ways to increase the speed and maximum temperature at which the pool would become heated using the vacuum intake port.

The body of the circulation accelerator has an elongated hollow tubular shape with openings at both ends. The body may be one fixed piece or multiple pieces that may adjust the overall length of the body. At the top (flange) end of the tube, the body is bent at a 90 degree angle to allow it to be attached to a pool's vacuum intake port. The bottom (base) end of the tube may be a variety of forms and have one or multiple openings or vents to all flow of water when the pool pump is turned on. When attached to the pool's vacuum intake port the base should be directed vertically to the bottom of the pool. The base has one or more fixed pedestals or feet that extend generally perpendicular from the base and abut the swimming pool wall. The body has a plurality of small holes located along the side of the body that face the pool wall when the flange is inserted into the pool's vacuum intake or skimmer port. The holes are a safety measure, which allow water to keep moving even if an object or debris blocks the primary intake vents.

The primary objective of the invention is to draw water from the bottom of the pool, which is typically cooler, and redistribute that water through the return jets. By drawing cooler water from close to the bottom of the pool through the pool's vacuum intake or skimmer port, a greater volume of water is circulated and displaced. The heated water then has the ability to permeate more thoroughly into the entire body of cold water in the pool at a faster rate, than if the pool water was drawn from the upper layer of the pool through the circulation systems currently in use. When used in conjunction with a swimming pool heating system, whether electric, gas or solar, the invention has an advantage of heating a swimming pool's water at a faster, more efficient rate than previously realized and the pool temperature will be consistent from top to bottom. Even if no heating system is employed, the invention naturally increases the temperature of pool water by drawing cooler, lower level water to the surface, which is then heated by the sun.

Other objectives of the invention is to circulate pool water at a faster rate and more thoroughly, which in turn circulates chemicals at a faster rate and more thoroughly throughout the pool water. The advantages of the increased circulation of water and chemicals throughout the pool is a slowing of algae growth, a reduction in the amount of chemicals and other products needed to treat the pool and a reduction in the amount of time required to incorporate chemicals into the pool before use. When algae growth is reduced, the result is deceased consumption of chemical products by consumers, fewer containers for the chemical products would need to be manufactured, and finally, the need to dispose of, or recycle these containers would be reduced.

By providing the objective of improved circulation from the bottom of the pool up towards the surface of the pool, and throughout the pool, chemical mixing for pool maintenance becomes more efficient. This increased efficiency of time will help to reduce the time required to run the pool pump, thus using less electricity or fuel and less wear and tear on the pool pump. This objective in turn saves natural resources, reduces pollution, and saves the consumer money.

There are numerous advantages of the invention:

2. Slows algae growth on the floor and sides of the swimming pool.
3. Improves circulation of chemicals when maintaining a swimming pool.
4. Provides water movement and circulation at the bottom layers of the pool, and at the upper layers of the pool simultaneously.
5. Eliminates temperature variations between the top and bottom layers of pool water.
6. Increased and simultaneous circulation reduces the amount of time needed to run the pool pump and pool heating systems.
7. Increased and simultaneous circulation allows pool heating systems to exceed their normal operating maximum temperature and reaches any given temperature at a faster rate.
8. Reduces the amount of chemicals needed to maintain pool water.
9. Reduces the frequency to chemically treat pool water.

These and other features, aspects and advantages of the present invention will become better understood with reference to the following drawings description and claims.

BRIEF DESCRIPTION OF THE SEVERAL VIEWS OF THE DRAWINGS

FIG. 2 illustrates a back elevation view of the adjustable pool water circulation accelerator shown in FIG. 1.

FIG. 3 illustrates a side elevation view of the adjustable pool water circulation accelerator shown in FIG. 1 and further reveals the paddle-like base having water intake vents, a pedestal or foot and a bottom drainage hole, while the upper and lower body sections each ave several back-up water intake holes should the water intake vents in the paddle-like base obstructed.

FIG. 4 illustrates a front elevation view of the adjustable pool water circulation accelerator shown in FIG. 1 and further reveals two pedestals or feet on the paddle-like base and water intake vents having an elongated configuration, in addition to four female adapters on the upper section of the body that assist in the adjustable connection between the upper and lower body sections, with the horizontally-extending broken line between the center two female adapters indicating the top end of the lower body section.

FIG. 5 illustrates a side elevation view of the adjustable pool water circulation accelerator shown in FIG. 1 with the top portion of the lower body section hidden within the upper body section and marked in broken lines and the protrusion near the top end of the lower body section that is used to engage the female adapters on upper body section also marked in broken lines.

DETAILED DESCRIPTION OF THE INVENTION

The following detailed description represents the most preferred embodiment, which is the prototype structure, but should only be taken as exemplary and not limiting, as other embodiments are also considered to be within the scope of the invention.

Referring to FIGS. 1, 3, 4 and 5, the most preferred embodiment of a pool water circulation accelerator 10 has a two-part body 12 in the form of an elongated tube made of metal, plastic, polymer or other rigid material. The body 12 has circumferences to accommodate the pool vacuum and skimmer intake ports having a variety of circumferences.

Figure 1:
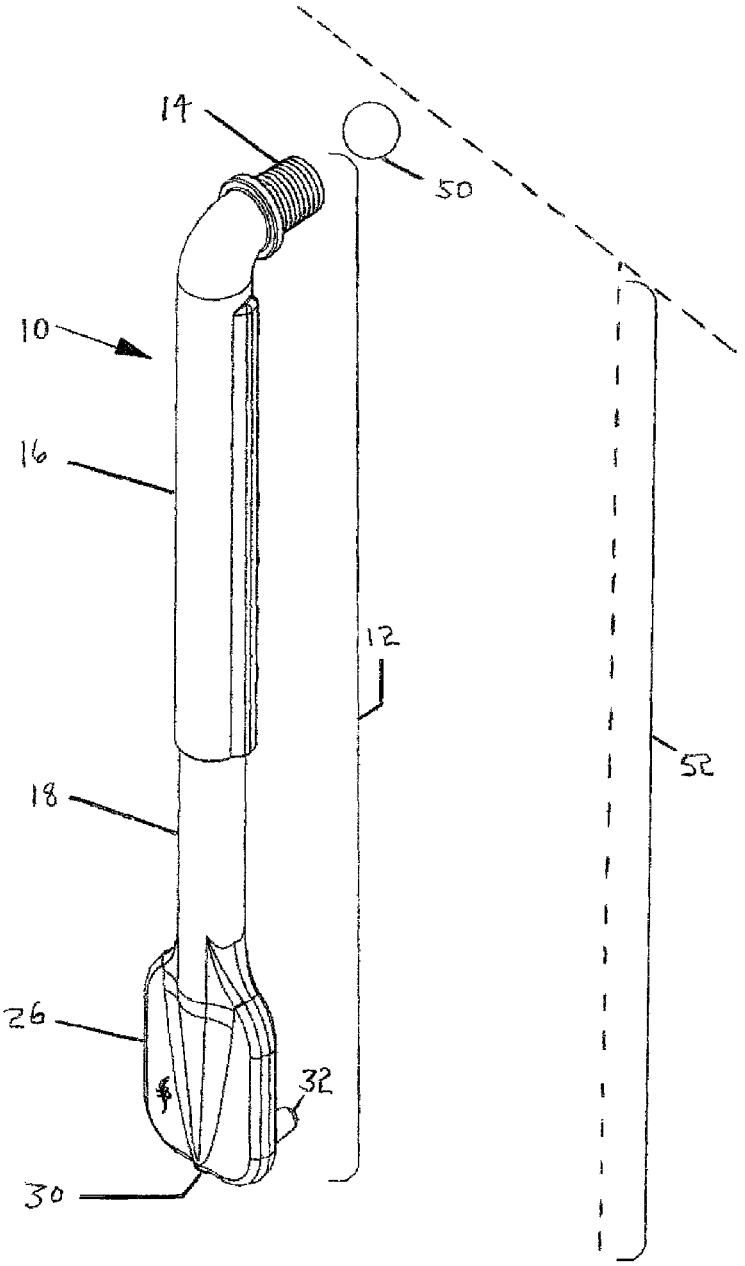
FIG. 1 illustrates a perspective elevation view of the adjustable pool water circulation accelerator according to the most preferred embodiment of the invention, showing a two-part body with its upper section having a top flange portion angled for connection to a pool vacuum or skimmer port, and its lower section having paddle-like base at its lower end, the broken lines generally indicating a pool wall adjacent to the circulation accelerator.
Figure 6:
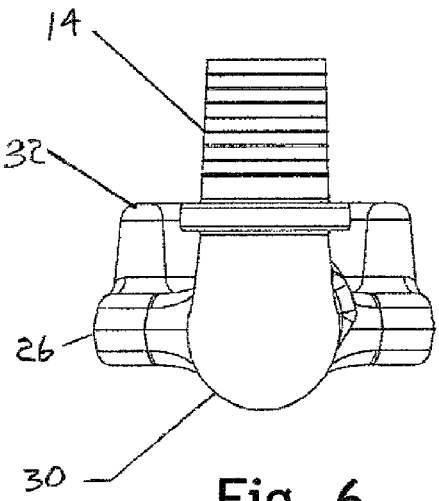
FIG. 6 illustrates a top elevation view of the upper section of the adjustable pool water circulation accelerator shown in FIG. 1 with the top flange portion of the upper body section centrally located and the paddle-like base and one of this pedestals or foot visible on each side of the tip flange portion.

Referring to FIG. 1, depending on the circumference of the pool vacuum or skimmer port 50 encountered the circumference of the tube is approximately six inches (6"). Depending on the depth of the pool 52 encountered the length of the body is approximately thirty-six inches (36").

The flange portion 14 of the body 12 extends perpendicular or orthogonal to the body 12 for insertion into the pool vacuum port and decreases in circumference gradually to accommodate a variety of pool vacuum port circumferences. The flange portion 14 of the body 12 has ridges to increase friction at the point of attachment to pool vacuum intake port.

Referring to FIGS. 2, 3, 4 and 5, the body 12 is in two sections that connect and adjust the body 12 to a variety of lengths. For example, the lower section 18 of the body 12 connects and adjusts by sliding into the upper section 16 of the body 12. If the lower section 18 of the body 12 is to connect by sliding into the upper section 16 of the body 12, then for example the exterior of the lower section 18 of the body 12 will have one raised protrusion 24 as male adaptor for attachment. If the lower section 18 of the body 12 is to connected by sliding into the upper section 16 of the body 12, then for example the interior of the upper section 16 of the body 12 will have depressions or channels [the reverse/exterior surfaces of which form raised mounds 22, see FIGS. 3-5] at several intervals as female adaptors for attachment. As mentioned above, when used the depressions or channels on the interior of the upper section 16 of the body 12 will appear as raised mounds 22 on the exterior of the upper section 16 of the body 12. The bottom portion of the lower section 18 of the body 12 may be in a variety of forms, but the prototype structure in FIGS. 1, 2, and 4 shows the body 12 flattening into a paddle-like shape or base 26 having a width dimension along a first axis greater than the width dimension of the tubular portion of lower section 18 depending upwardly from base 26 and a width dimension along a second axis substantially perpendicular to said first axis smaller than the width dimension of the tubular portion of lower section 18 depending upwardly from base 26. The base 26 of the body 12 has multiple openings 28. While one large opening will function as well as smaller multiple openings, it is not preferred for safety reasons. The openings 28 do not require any specific shape or size, but should allow sufficient volume of water to flow into and through the body 12. The prototype structure in FIG. 4 shows the base 26 of the body 12 with multiple openings in twenty-six elongated vent shapes 28.

Figure 7:
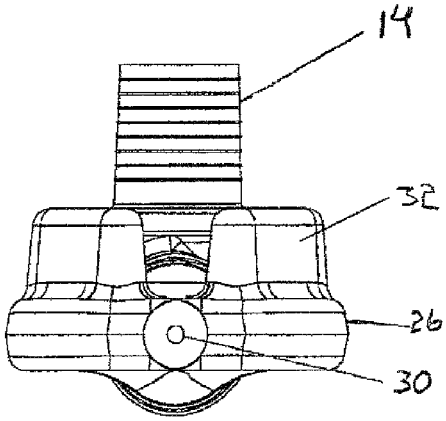
FIG. 7 illustrates a bottom elevation view of the adjustable pool water circulation accelerator shown in FIG. 1 and further reveals the drain hole at the bottom of the paddle-like base.

FIG. 7 shows the base 26 of the body 12 has an additional hole 30 at the lowest point. This additional hole 30 provides drainage when the circulation accelerator is removed from the pool.

The base 26 of the body 12 has two pedestals or feet 32 that provide stability by extending just far enough to abut the vertical wall near the bottom of the pool. The prototype structure in FIG. 4 shows two protrusions 32 at approximately a 45 degree angle on the surface of the base 26 of the body 12.

Along the length of the body 12 there are multiple openings 34. These openings provide a measure of safety for the pool pump should the base 26 opening(s) 28 become obstructed. FIGS. 3-5 show a series of two small holes 34 in five locations up the length of the body 12 (some on the upper section 16 of the body 12 and others on the lower section 18 of body 12), for a total of ten small holes 34.

The flange portion 14 of the body 12 is shaped to attach to a vacuum hose for use with a pool skimmer intake port. If the invention is attached to a pool skimmer intake port, the flange portion 14 of the body 12 may require an additional apparatus to anchor the invention into a vertical position.

While the invention has been particularly shown and described with respect to the illustrated embodiments thereof, it will be understood by those skilled in the art that the foregoing and other changes in form and details may be made therein without departing from the spirit and scope of the invention.

What is claimed is:

1. An apparatus for circulating pool water at an accelerated rate when said apparatus is attached to pool vacuum intake and pool skimmer ports and pool circulation equipment is turned on, said apparatus comprising:

an elongated body having an upper section, a lower section with a bottom base, and opposed ends, with openings at each of said opposed ends;

said upper section portion of said body bending generally at a 90 degree angle to said body, forming a flange to insert into pool vacuum intake or skimmer ports; and said bottom base portion of said lower section having at least one opening and directed to the bottom of the pool with the length of said body generally parallel to the plane of the pool wall and generally perpendicular to the plane of the pool deck, said bottom base portion also having at least one water intake vent directed to the plane of the pool wall, said at least one opening directed to the bottom of the pool and said at least one water intake vent directed to the plane of the pool wall drawing in and substantially directing bottom pool water through said upper section of said elongated body and into the pool vacuum intake or skimmer port, allowing faster pool water movement and circulation in the bottom layers of the pool water for faster elimination of temperature variations between top and bottom layers of pool water and enhanced circulation of pool water treatment chemicals through all pool water layers, said bottom base portion of said body further having protrusions perpendicular to said body, said protrusions selected from a group consisting of pedestals and feet, said protrusions having a length for abutting the pool wall at a location substantially vertically below the pool vacuum intake or skimmer port.

2. The apparatus as in claim 1 wherein said bottom base portion of said body has at least one opening the dimension of which generally total the intake water volume of said body's circumference, said at least one opening located generally on the side of said body that faces the pool wall when said flange is inserted into the pool vacuum intake or skimmer port.

3. The apparatus as in claim 1 wherein said bottom base portion of said body has a lowest vertical point and said bottom base portion further comprises an additional hole at said lowest vertical point.

4. The apparatus as in claim 1 wherein said tubular portion of said body further comprises a plurality of small holes located substantially on the side of said body that faces the pool wall when the flange is inserted into the pools vacuum intake or skimmer port.

5. The apparatus as in claim 1 wherein said body is comprised of multiple fixed lengths that when joined in their locked position generally equal the distance between a pool vacuum intake port or skimmer port and the bottom of the pool.

6. The apparatus as in claim 5 wherein said body adjusts to variable locked lengths of approximately thirty-two to thirty-eight inches to accommodate variations in pool depths and collapses for shipping, storage or transport to an approximate length of twenty-eight inches.

7. The apparatus as in claim 5 wherein one of said multiple fixed lengths of said body has an exterior surface and having a male adaptor incorporated along its exterior surface.

8. The apparatus as in claim 5 wherein one of said multiple fixed lengths of said body having a larger circumference to sheath the other multiple fixed length and having female adaptors incorporated along its interior surface at intervals of approximately two inches on center.

9. The apparatus as in claim 5 wherein the tubular portions of said body having a plurality of small holes located generally on the side of said body that faces the pool wall when the flange is inserted into the pools vacuum intake or skimmer port.

10. The apparatus as in claim 1 wherein said body is an integrated unit.

11. The apparatus as in claim 1 wherein said body comprises at least two adjustably connectable sections, allowing longitudinal extension and contraction.

12. The apparatus as in claim 1 wherein said opening in said flange decreases in circumference between said bend and said end opening.

13. The apparatus as in claim 1 wherein said bottom base portion of said body has a flattened configuration.

14. The apparatus as in claim 13 wherein said flattened configuration of said bottom base portion further comprises flattening creating a width dimension along a first axis greater than the width dimension of said tubular portion of said lower section depending upwardly from bottom base portion, while also creating a width dimension along a second axis substantially perpendicular to said first axis that is smaller than the width dimension of said tubular portion of said lower section depending upwardly from bottom base portion.

15. The apparatus as in claim 14 wherein said flattened configuration further comprises flattening of said bottom base portion into a paddle-like shape.

16. The apparatus as in claim 1 wherein said body is substantially a tubular shape having a circumference approximately equal to the circumference of a standard pool vacuum intake or skimmer port approximately six inches in circumference.

17. The apparatus as in claim 1 wherein said body is a single fixed length of approximately thirty-six inches.

18. The apparatus as in claim 1 wherein said flange has an elevated texture selected from a group consisting of ribs and threads.

* * * * *